US006788254B2

(12) United States Patent
Oh et al.

(10) Patent No.: US 6,788,254 B2
(45) Date of Patent: Sep. 7, 2004

(54) WIDEBAND INTERNAL ANTENNA WITH ZIGZAG-SHAPED CONDUCTIVE LINE

(75) Inventors: Jeong-Kun Oh, Kyounggi-Do (KR); Kyung-Min Lee, Kyounggi-Do (KR); Je-Min Lee, Chungcheongnam-Do (KR); Yon-Seo Park, Seoul (KR)

(73) Assignee: Ace Technology, Kyounggi-Do (KR)

( * ) Notice: Subject to any disclaimer, the term of this patent is extended or adjusted under 35 U.S.C. 154(b) by 124 days.

(21) Appl. No.: 10/177,723

(22) Filed: Jun. 21, 2002

(65) Prior Publication Data

US 2003/0076267 A1 Apr. 24, 2003

Related U.S. Application Data

(63) Continuation of application No. PCT/KR01/01800, filed on Oct. 24, 2001.

(51) Int. Cl.[7] ..... H01Q 1/38; H01Q 1/24
(52) U.S. Cl. ..... 343/700 MS; 343/702
(58) Field of Search ..... 343/700 MS, 702, 343/895, 846, 848

(56) References Cited

U.S. PATENT DOCUMENTS 4,571,595 A * 2/1986 Phillips et al. ..... 343/745
4,740,794 A * 4/1988 Phillips et al. ..... 343/702
4,868,576 A * 9/1989 Johnson, Jr. ..... 343/702
5,561,437 A * 10/1996 Phillips et al. ..... 343/702
6,320,545 B1 * 11/2001 Nagumo et al. ..... 343/700 MS
6,388,626 B1 * 5/2002 Gamalielsson et al. ..... 343/702
6,417,816 B2 * 7/2002 Sadler et al. ..... 343/795
6,456,246 B2 * 9/2002 Saito ..... 343/702
6,466,174 B2 * 10/2002 Haussler et al. ..... 343/702
6,486,834 B2 * 11/2002 Tsai ..... 343/702

* cited by examiner

*Primary Examiner*—Tan Ho
(74) *Attorney, Agent, or Firm*—Harness, Dickey & Pierce, P.L.C.

(57) ABSTRACT

A wideband built-in antenna in a portable terminal includes a ground plate electrically connected to a ground of the portable terminal, a radiation element for radiating radio waves, wherein the radiation element is formed into a zigzag shape having a predetermined thickness and width in parallel with the ground plate, a feeding point for feeding signals into the radiation element, a feeding probe connecting the feeding point to the radiation element and a holder for fixing the antenna to the portable terminal.

14 Claims, 9 Drawing Sheets

WIDEBAND INTERNAL ANTENNA WITH ZIGZAG-SHAPED CONDUCTIVE LINE

CROSS REFERENCE TO RELATED APPLICATION

This application is a continuation of International Application No. PCT/KR01/01800, filed Oct. 24, 2001 claiming priority to Korean Application No. 2000-62711, filed Oct. 24, 2000.

TECHNICAL FIELD

The present invention relates to an internal antenna built in a portable terminal for a mobile communication; and, more particularly, to a small-sized built-in antenna formed into a zigzag-shaped radiation element of metal material and having high radiation efficiency and a wideband characteristic.

DESCRIPTION OF THE PRIOR ART

Recently, antennas used in the most of portable terminals are external antennas of monopole and helical types having a length of $\lambda/4$ ($\lambda$ is a wavelength of a using frequency) or a retractable type combining the monopole and helical types. Since the above antennas are basically positioned at an outside of the portable terminal, it is difficult to reduce a size of the portable terminal. Accordingly, a research of a built-in antenna capable of being packaged within the portable terminal has been developed in order to reduce a size of the portable terminal.

A microstrip patch antenna technology using a printed circuit board (PCB), a ceramic chip antenna technology using a high dielectric material and an inverted F-type antenna technology have been recently developed. As the size of the antenna is reduced, these built-in antennas have a problem that a characteristic of an antenna is deteriorated due to an antenna design. Since the inverted F-type antenna uses a probe feeding way to feed signals to a radiation element, it has a very narrow bandwidth so that it is limited for a service requiring a wideband. When the ceramic antenna is used as a built-in antenna, a high dielectric material should be used to reduce a size of the antenna, however a gain loss of the antenna is caused. The microstrip patch antenna technology using the printed circuit board has advantages in that frequency tuning and bandwidth extension are possible by using various slot technologies and stacking technologies. However, it has a disadvantage that a volume of the antenna is highly increased.

FIG. 1 is a schematic view showing portable terminals having external antennas. A helical antenna 11 and a retractable antenna 12, which are generally used in the portable terminal, are shown. Since these antennas have a narrow bandwidth and a single band, it is limited for a system requiring a wide bandwidth. Also, since the antennas are positioned at an outside of the terminal, a specific absorption rate, which is affected on the human body, is high and undesired radiation waves are generated around the terminal.

SUMMARY OF THE INVENTION

It is, therefore, an object of the present invention to provide a wideband built-in antenna in a portable terminal for a mobile communication, which is capable of reducing a size of the antenna and obtaining a wideband effect by an electromagnetic coupling effect.

In accordance with an aspect of the present invention, there is provided a wideband built-in antenna in a portable terminal, comprising a radiation means for radiating radio waves, wherein the radiation means is formed into a zigzag-shaped conductive line having predetermined thickness and width.

In accordance with another aspect of the preset invention, there is provided a wideband built-in antenna in a portable terminal for mobile communication, comprising: a ground plate electrically connected to a ground of the portable terminal; a radiation means formed with a zigzag shaped conductive line having predetermined thickness and width in parallel with the ground plate at a predetermined distance; a feeding point for feeding signals to the radiation element; a feeding probe for connecting the radiation element to the feeding point; and a fixing means for fixing the antenna to the portable terminal.

BRIEF DESCRIPTION OF THE DRAWINGS

Other objects and aspects of the invention will become apparent from the following description of the embodiments with reference to the accompanying drawings, in which.

DETAILED DESCRIPTION OF THE PREFERRED EMBODIMENTS

Hereinafter, a built-in antenna in a portable terminal for a mobile communication according to the present invention will be described in detail referring to the accompanying drawings.

Figure 1:
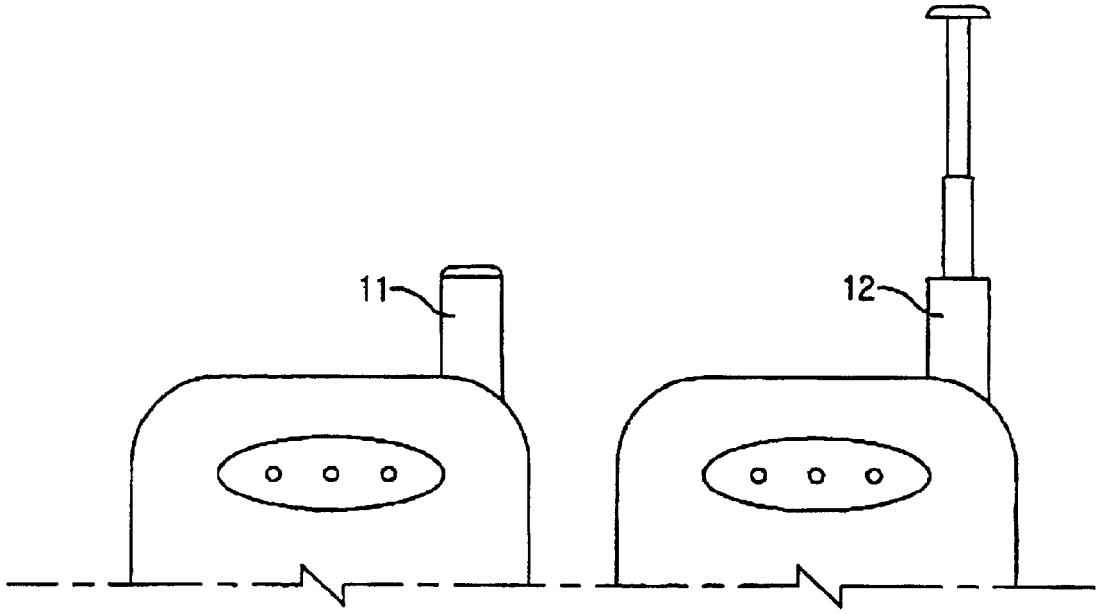
FIG. 1 is a schematic view showing portable terminals having external antennas.
Figure 2A:
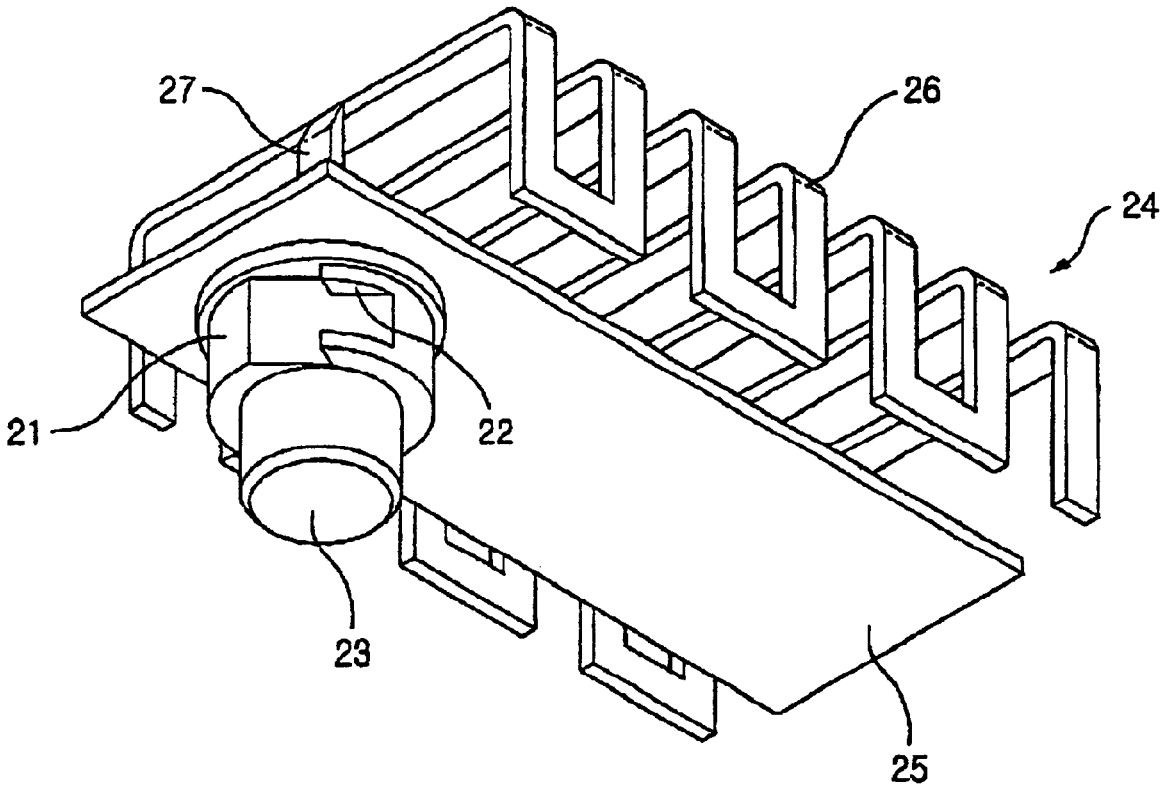
FIG. 2A is a perspective view showing a wideband built-in antenna according to a first embodiment of the present invention.

FIG. 2A is a perspective view showing a wideband built-in antenna according to the present invention.

Referring to FIG. 2A, the wideband built-in antenna includes a feeding point 23 for feeding signals from an built-in circuit of the portable terminal, a radiation element 26 for transmitting and receiving radio waves, a feeding probe 27, which is connected between the feeding point 23 and the radiation element 24, for transmitting signals from the feeding point 23 to the radiation element 24, a ground plate 25, which is electrically connected to ground of the terminal, maintaining a predetermined distance to the radiation element 24 and a fixing unit 21 for fixing the wideband built-in antenna to the portable terminal.

The radiation element 24 is a conductive line having a predetermined thickness and width and the conductive line is formed into a zigzag shape. In order to reduce a size of the antenna, the radiation element 24 is bent at both sides thereof. That is, the predetermined portions of the radiation element 24 are vertically bent toward the ground plate 25 so that a bending portion 26 is formed.

The fixing unit 21 includes a latch 22 to firmly fix the antenna to the portable terminal and the ground plate 25 is joined to the fixing unit 21. The fixing unit 21 is also joined to the printed circuit board (PCB) through the latch 22. The radiation element 24 and the ground plate 25 are spaced out to a predetermined distance apart in parallel so that a wideband of the antenna is implemented by an electromagnetic coupling effect between the radiation element 24 and the ground plate 25.

Figure 2B:
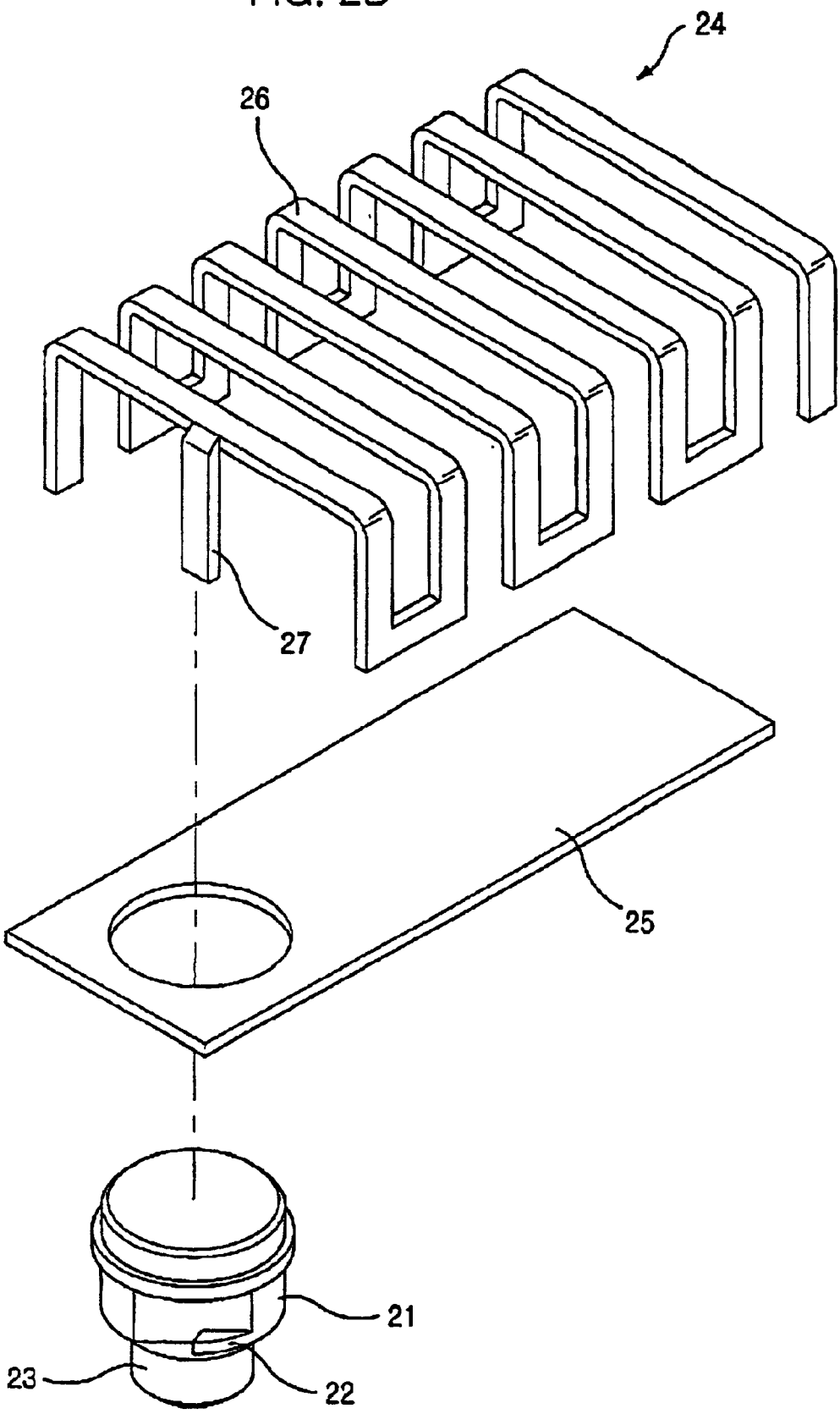
FIG. 2B is an exploded perspective view showing the wideband built-in antenna in FIG. 2A.

FIG. 2B is an exploded perspective view showing the wideband built-in antenna according to the present invention.

Referring to FIG. 2B, the feeding point 23, the feeding probe 27 and the ground plate 25 are joined by the fixing unit 21 having the latch 22 capable of being fixed to the printed circuit board in the center. An aperture is formed at a left side of the ground plate 25 of a plate type and the ground plate 25 is joined to the fixing unit 21 through the aperture. The feeding probe 27 is electrically connected to the feeding point 23, which is passed through the fixing unit 23, by passing trough the aperture.

Figure 3:
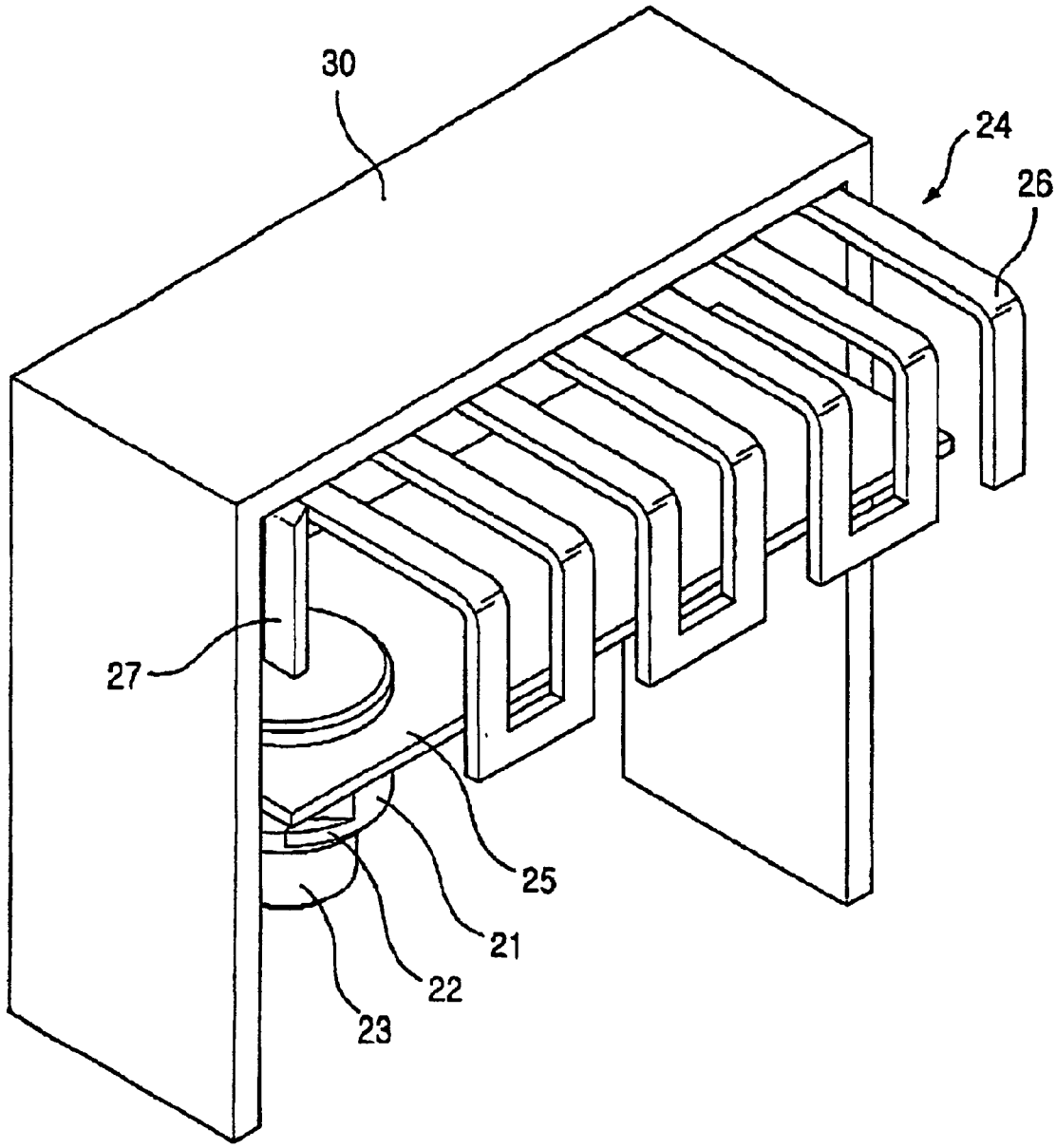
FIG. 3 is a perspective view showing the wideband built-in antenna in FIG. 2A built in the portable terminal according to the present invention.

FIG. 3 is a perspective view showing the wideband built-in antenna in FIG. 2A built in the portable terminal according to the present invention.

Referring to FIG. 3, the wideband built-in antenna is built in the portable terminal and the antenna may be fixed to a certain housing by using the latch 21.

Figure 4:
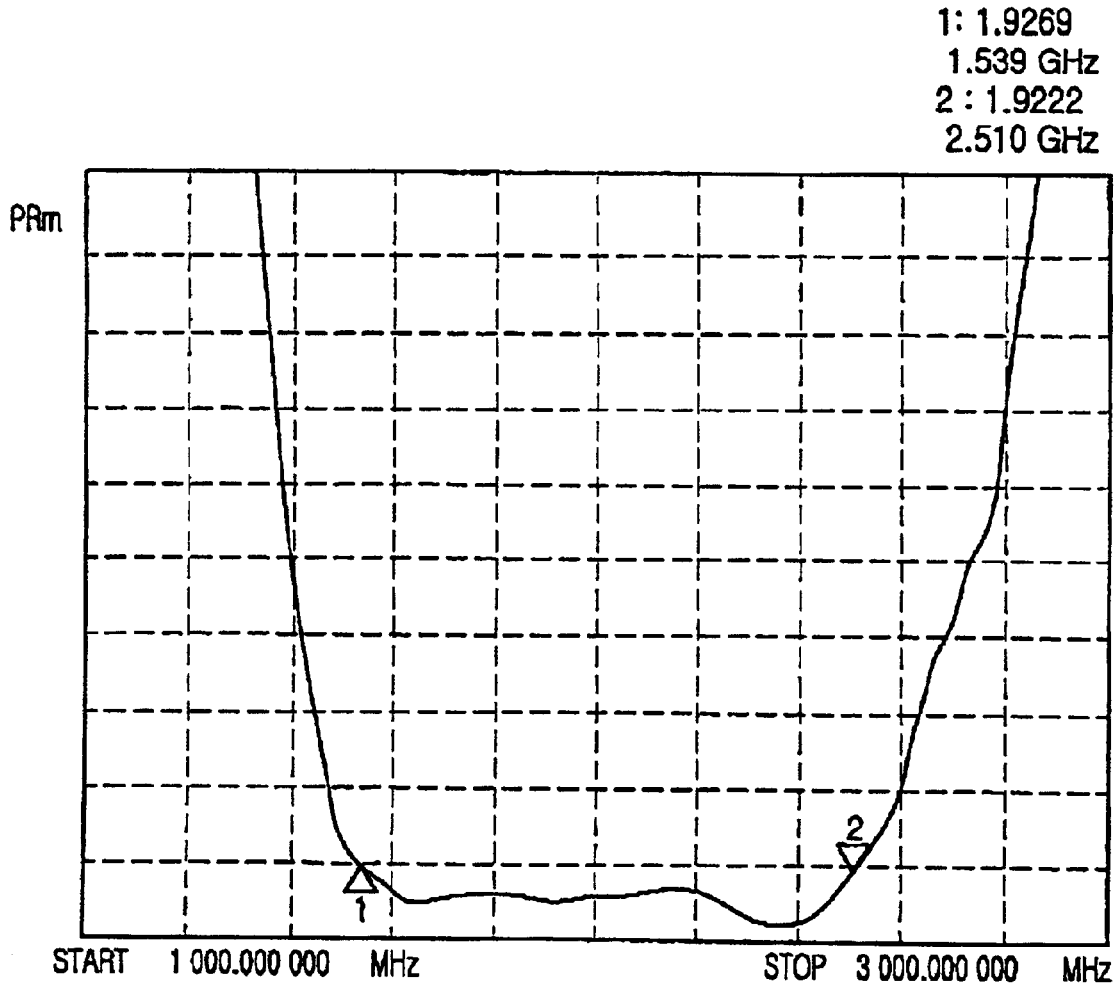
FIG. 4 is a graph showing a voltage standing wave ratio (VSWR) of the wideband built-in antenna in FIG. 2A.

FIG. 4 is a graph showing a voltage standing wave ratio (VSWR) of the wideband built-in antenna in FIG. 2A.

Referring to FIG. 4, when the reference VSWR is 1.9, the VSWR is less than 1.9 at frequency bards between the number '1' and the number '2' and, at this time, a bandwidth is about 980 MHz (1.53 GHz to 2.51 GHz). Namely, the antenna has a wide bandwidth according to the present invention.

Figure 5A:
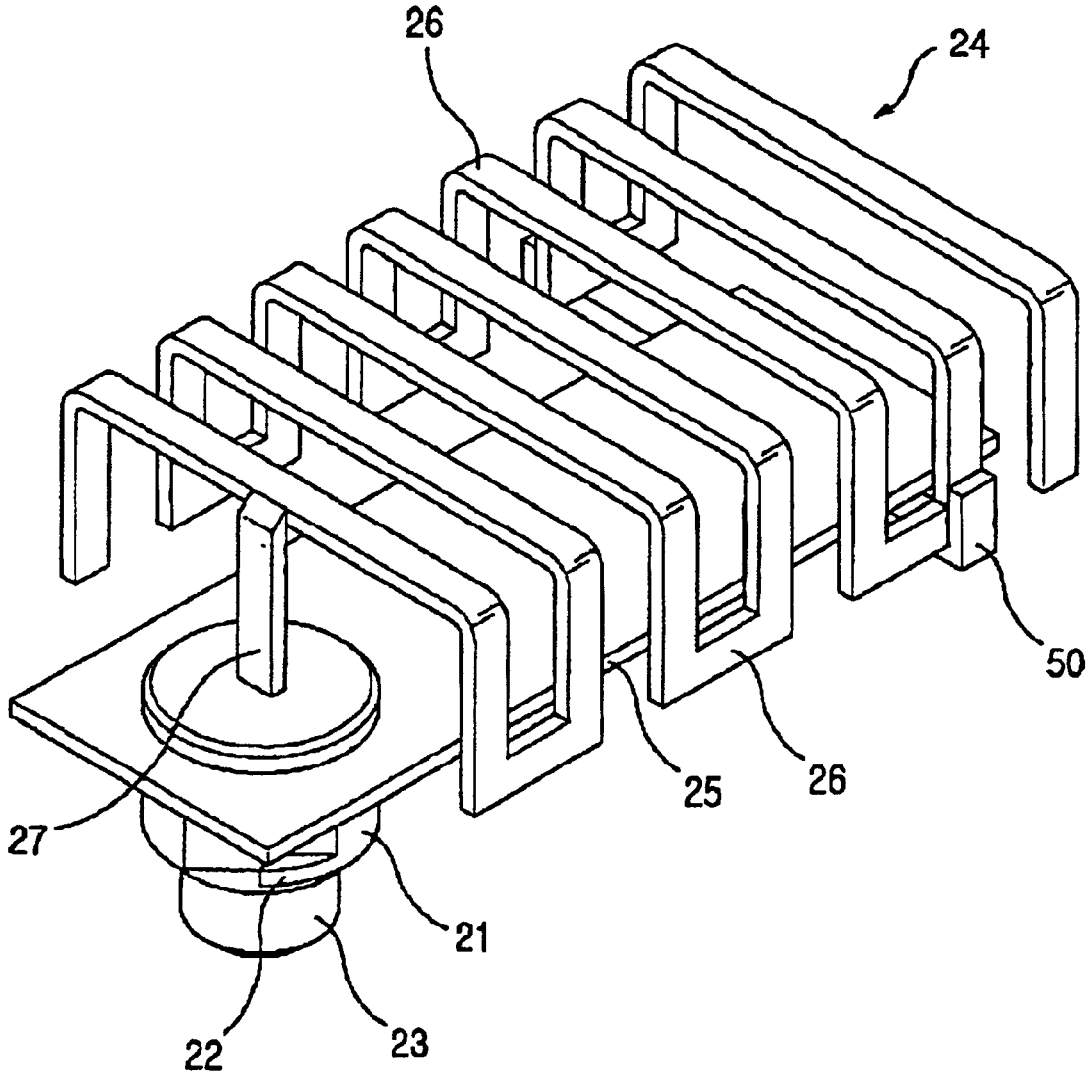
FIG. 5A is a perspective view showing an antenna according to a second embodiment of the present invention.

FIG. 5A is a perspective view showing an antenna according to a second embodiment of the present invention.

Referring to FIG. 5A, the second embodiment of the present invention further includes a supporting piece 50 position at the opposite side of the feeding probe 27, which a conductive line is bent, one side is joined at end of the bending portion 26 and the other side is joined to a bottom plane of the ground plate 25, to more firmly fix the radiation element 24. Since the radiation element 24 is fixed at the central axis of the fixing unit 21 and is longitudinally formed along the ground plate 25, the center of the gravity leans toward one side so that a stability of the antenna may be decreased. Especially, since a weight of the radiation element 24 is supported only by the feeding probe 27, an additional supported is required.

Figure 5B:
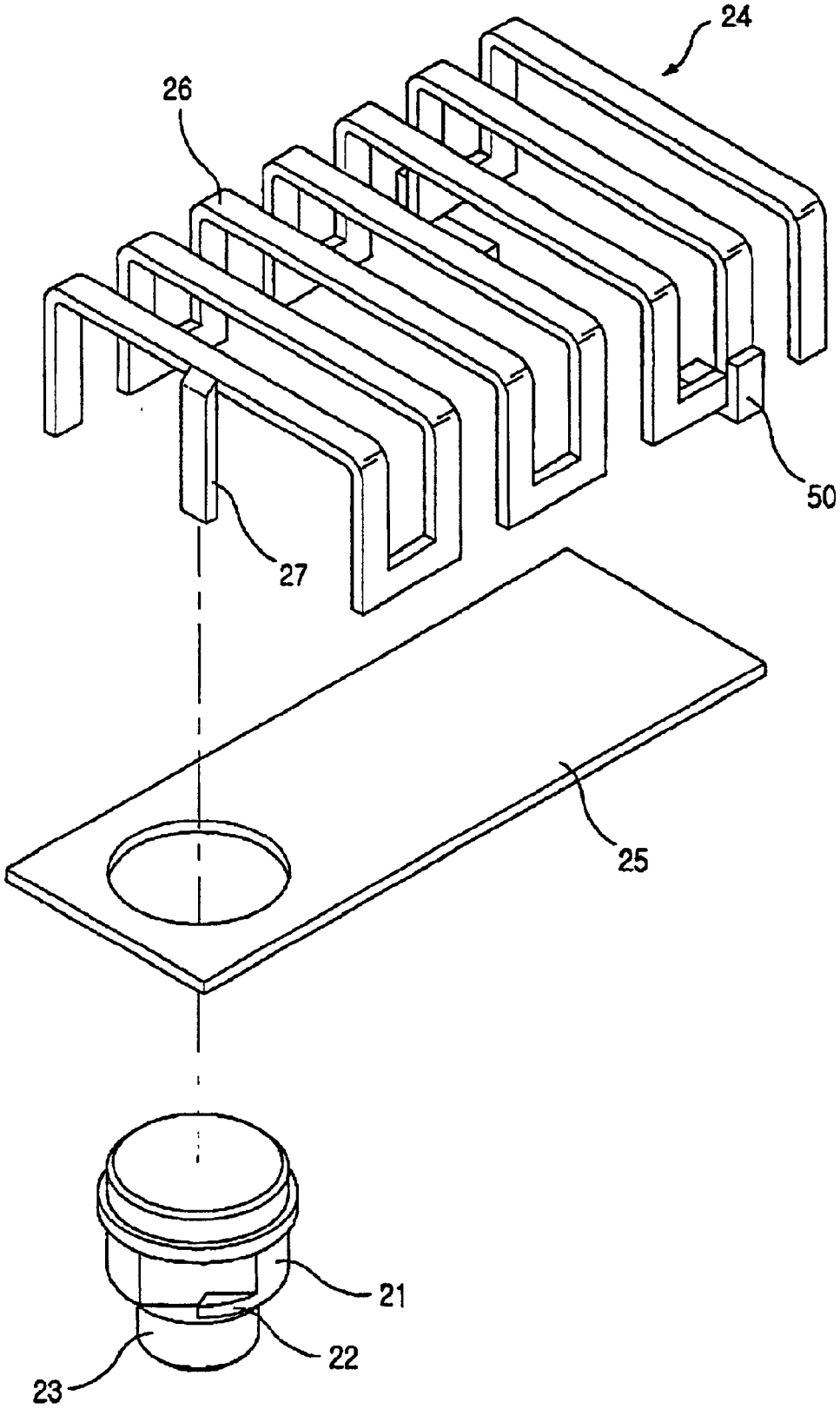
FIG. 5B is an exploded perspective view showing the antenna if FIG. 5A.

FIG. 5B is an exploded perspective view showing the antenna in FIG. 5A according to the second embodiment of the present invention.

Referring to FIG. 5B, the bending portion 26, which a portion of the radiation element 24 is bent as much as a predetermined length, is connected by the connector 50 so that the radiation element 24 and the ground plate 25 can more firmly fixed each other.

Figure 6A:
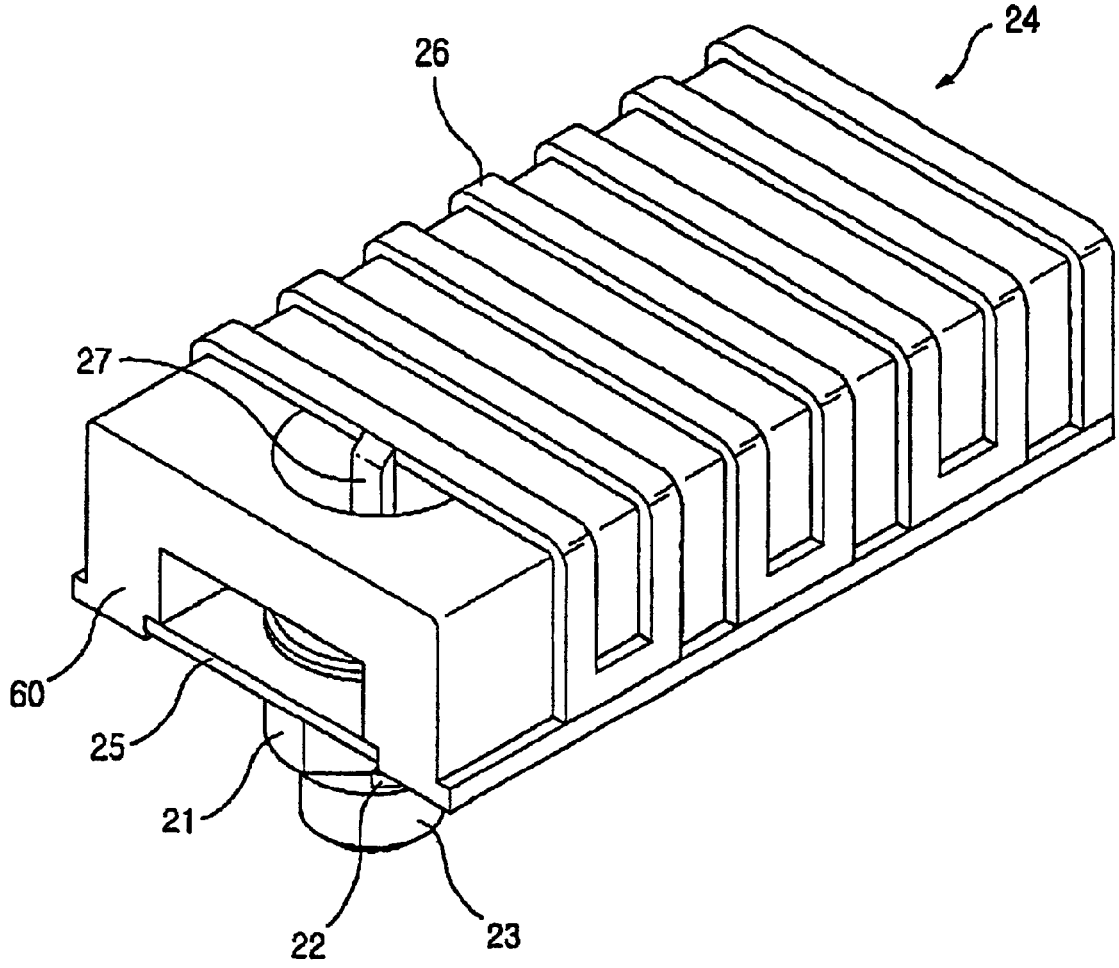
FIG. 6A is a perspective view showing an built-in antenna according to a third embodiment of the present invention.
Figure 6B:
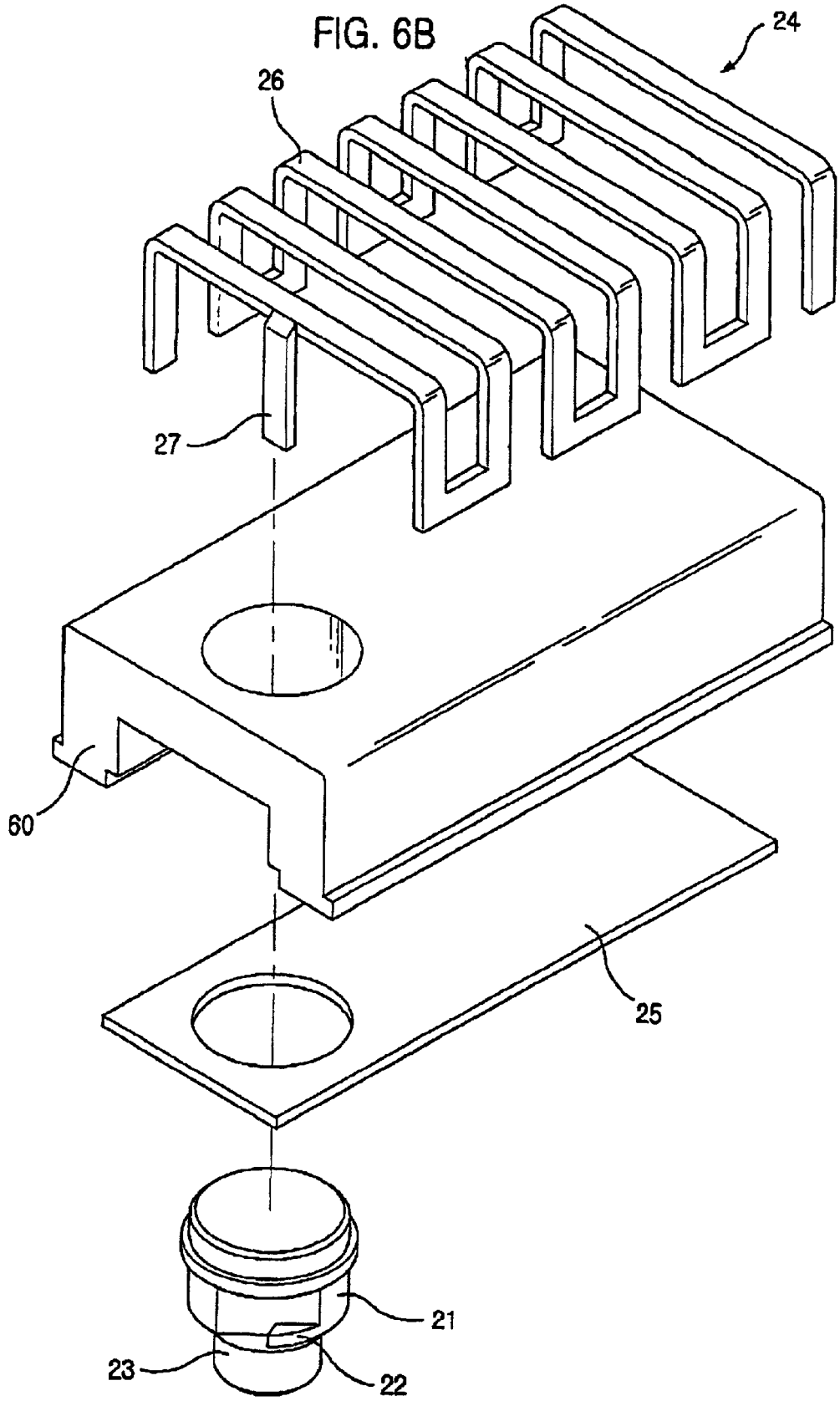
FIG. 6B is an exploded perspective view showing the built-in antenna in FIG. 6A.

FIG. 6A is a perspective view showing an built-in antenna according to a third embodiment of the present invention and FIG. 6B is a exploded perspective view showing the built-in antenna in FIG. 6A.

Referring to FIGS. 6A and 6B, an insulator 60 is used between the radiation element 24 and the ground plate 25 in FIG. 2A so that the antenna may be structurally stabilized. The insulator 60 has an opening, which is matched with a central axis of the opening of the ground plate 25. The insulator 60 plays a role of supporting the entire radiation element 24 including the bending portion 26.

Accordingly, since the wideband built-in antenna according to the present invention can be directly packaged at the printed circuit board of the portable terminal, mass production according to factory automation is possible and a size of the portable terminal can be reduced.

Also, since the ground plate 25 is equipped parallel with the radiation element maintaining a predetermined distance, an effect due to electric and magnetic fields of the antenna may be minimized to the built-in circuit of the portable terminal. Since the radiation element is bent, the size of the antenna can be reduced. A wideband effect can be expected by an electromagnetic coupling effect between the radiation element and the ground plate.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A wideband built-in antenna in a portable terminal for mobile communication, comprising:

a ground plate electrically connected to a ground of the portable terminal;

a radiation means formed into a zigzag-shaped conductive line having predetermined thickness and width parallel with the ground plate at a predetermined distance, wherein the radiation means is formed with a metal material;

a feeding point for feeding signals to the radiation means;

a feeding probe for connecting the radiation means to the feeding point; and a fixing means for fixing the antenna to the portable terminal;

wherein the ground plate includes an opening formed at the left side to be joined to the fixing means.

2. The wideband built-in antenna as recited in claim 1, wherein the radiation means is bent at predetermined positions from both sides thereof.

3. The wideband built-in antenna as recited in claim 2, further comprising supporting means for fixing the radiation means to the ground plate.

4. The wideband built-in antenna as recited in claim 2, further comprising an insulator between the radiation means and the ground plate.

5. The wideband built-in antenna as recited in claim 4, wherein the insulator includes an opening, which is matched with a central axis of the opening of the ground plate, to be joined to the fixing means.

6. A wideband built-in antenna in a portable terminal for mobile communication, comprising:

a ground plate electrically connected to a ground of the portable terminal;

a radiation element for transmitting and receiving radio waves, the radiation element formed into a conductive line having predetermined thickness and width parallel with the ground plate at a predetermined distance;

a feeding point for feeding signals to the radiation element;

a feeding probe for connecting the radiation element to the feeding point; and a fixing unit for fixing the antenna to the portable terminal;

the ground plate including an opening receiving the fixing unit.

7. The wideband built-in antenna as recited in claim 6, wherein the radiation element is formed with a metal material.

8. The wideband built-in antenna as recited in claim 6, wherein the opening is formed at a side of the ground plate.

9. The wideband built-in antenna as recited in claim 6, wherein the radiation element is bent at predetermined positions from both sides thereof.

10. The wideband built-in antenna as recited in claim 6, further comprising a support piece for fixing the radiation element to the ground plate.

11. The wideband built-in antenna as recited in claim 6, further comprising an insulator between the radiation element and the ground plate.

12. The wideband built-in antenna as recited in claim 6, wherein the insulator includes an opening matched with a central axis of the opening of the ground plate.

13. The wideband built-in antenna as recited in claim 6, wherein the conductive line has a zigzag shape.

14. The wideband built-in antenna as recited in claim 6, in combination with the portable terminal.

* * * * *